US006321658B1

(12) United States Patent
Pabst et al.

(10) Patent No.: US 6,321,658 B1
(45) Date of Patent: Nov. 27, 2001

(54) MOBILE JAW VICE FOR CLAMPING AND UNCLAMPING VEHICLES TO AND FROM A TRACTION CABLE OF A TRANSPORT SYSTEM

(75) Inventors: Otto Pabst, Rio Pusteria; Ferruccio Levi, Cologno Monzese, both of (IT)

(73) Assignee: Leitner S.p.A., Vipiteno (IT)

( * ) Notice: Subject to any disclaimer, the term of this patent is extended or adjusted under 35 U.S.C. 154(b) by 0 days.

(21) Appl. No.: 09/635,766

(22) Filed: Aug. 11, 2000

(30) Foreign Application Priority Data

Aug. 18, 1999 (IT) ..... MI99A1822

(51) Int. Cl.[7] ..... B61B 12/12

(52) U.S. Cl. ..... 104/202; 104/206; 104/209; 104/216

(58) Field of Search ..... 104/206, 209, 104/216, 180, 202

(56) References Cited

U.S. PATENT DOCUMENTS 913,775 * 3/1909 Seymour ..... 104/209
2,955,544 * 10/1960 Goirand ..... 104/180
5,111,751 * 5/1992 Zlotek ..... 104/209
5,595,122 * 1/1997 Levi et al. ..... 104/173.1

FOREIGN PATENT DOCUMENTS 0 327 882 8/1989 (EP) .
0 644 095 3/1995 (EP) .
0 687 608 12/1995 (EP) .

* cited by examiner

*Primary Examiner*—S. Joseph Morano
*Assistant Examiner*—Frantz F. Jules
(74) *Attorney, Agent, or Firm*—Oblon, Spivak, McClelland, Maier & Neustadt, P.C.

(57) ABSTRACT

A mobile jaw (11,12) vice (10) for clamping and unclamping vehicles (19) to and from a traction cable (13) of a single-cable or two-cable transport system, such as a chair lift, a funicular cableway and a city transport system or a telpher, comprising a lever system (14, 15, 16) for arm (17, 18) and jaw (11, 12) handling, adapted to guarantee a suitable opening and an effective grip of the vice (10) onto the cable (13) also in case of wide oscillations of the vehicle (19).

8 Claims, 5 Drawing Sheets

MOBILE JAW VICE FOR CLAMPING AND UNCLAMPING VEHICLES TO AND FROM A TRACTION CABLE OF A TRANSPORT SYSTEM

BACKGROUND OF THE INVENTION

1. Field of the Invention

Object of the present invention is a mobile jaw vice for clamping and unclamping vehicles to and from a traction cable of a transport system.

2. Description of the Background

The traction-cable rail transport systems currently known make use of synchronised braking or acceleration rollers of the vehicle (usually a cab) in the proximity of terminal or intermediate stations of a determined funicular route to be covered; a two mobile-jaw vice, connected to the cab floor, is used for unclamping the vehicle from the traction cable when the rollers decelerate the vehicle and, analogously, the jaws of the vice are driven so as to grip the cable when the run restarts and the vehicle is accelerated.

Nevertheless, the jaws used exhibit some disadvantages during the closing step, above all if the vehicle makes wide oscillations, due to the load or to dynamic stresses; in fact in this case also the traction cable may oscillate widely, thus significantly reducing the area of the portion of the grip synchronism. Moreover, the passage from the traction through cable to traction through draft wheels can cause serious defects, such as for example, pulsed stresses and excessive wear of the mechanical members on which the above cable can engage, in case the rollers are arranged in determined positions adapted to follow particular routes such as, for example, curvilinear and at the same time, rising trajectories.

SUMMARY OF THE INVENTION

Thus, an objective of the present invention is that of providing an improved mobile jaw vice for clamping and unclamping vehicles to and from a traction cable of a transport system, which should overcome the disadvantages mentioned above, that is to say, that of providing an improved mobile jaw vice which should allow attaining a firm and safe grip in all cases, also when the vehicle makes significant oscillations in vertical and horizontal direction, caused by the load variation due, for example, to the passengers' boarding and getting off, or to external dynamic stresses.

Another objective of the invention is that of providing an improved mobile jaw vice for clamping and unclamping vehicles to and from a traction cable of a transport system, which should guarantee a substantially large symmetrical opening of the jaws with respect to the diameter of the traction cable.

Further objective of the present invention is that of indicating an improved mobile jaw vice which should allow creating a sufficient space for housing, in horizontal position, a cable-guiding roller so as to minimise the stresses to which the same cable is subject.

Said objectives are attained by an improved mobile jaw vice for clamping and unclamping vehicles to and from a traction cable of a transport system, according to claim 1, to which reference shall be made for brevity.

Advantageously, the mobile jaw vice according to the invention allows arranging and orientating at will and need along the system, the cable-guiding line rollers so as to allow the guiding rail to cover any trajectory, such as for example, a curvilinear and rising or descent trajectory.

In this way, the cable is prevented from imparting undesired stresses to the cable-guiding rollers. Moreover, the particular arrangement of the cable-guiding rollers according to the invention guarantees a perfect guide of the cable and avoids an undesired and dangerous slipping out of the same.

BRIEF DESCRIPTION OF THE DRAWINGS

The features of the invention will appear more clearly from the following description and attached drawings, relating to an exemplificative and non-limitative embodiment, wherein.

DESCRIPTION OF THE PREFERRED EMBODIMENTS

Figure 1:
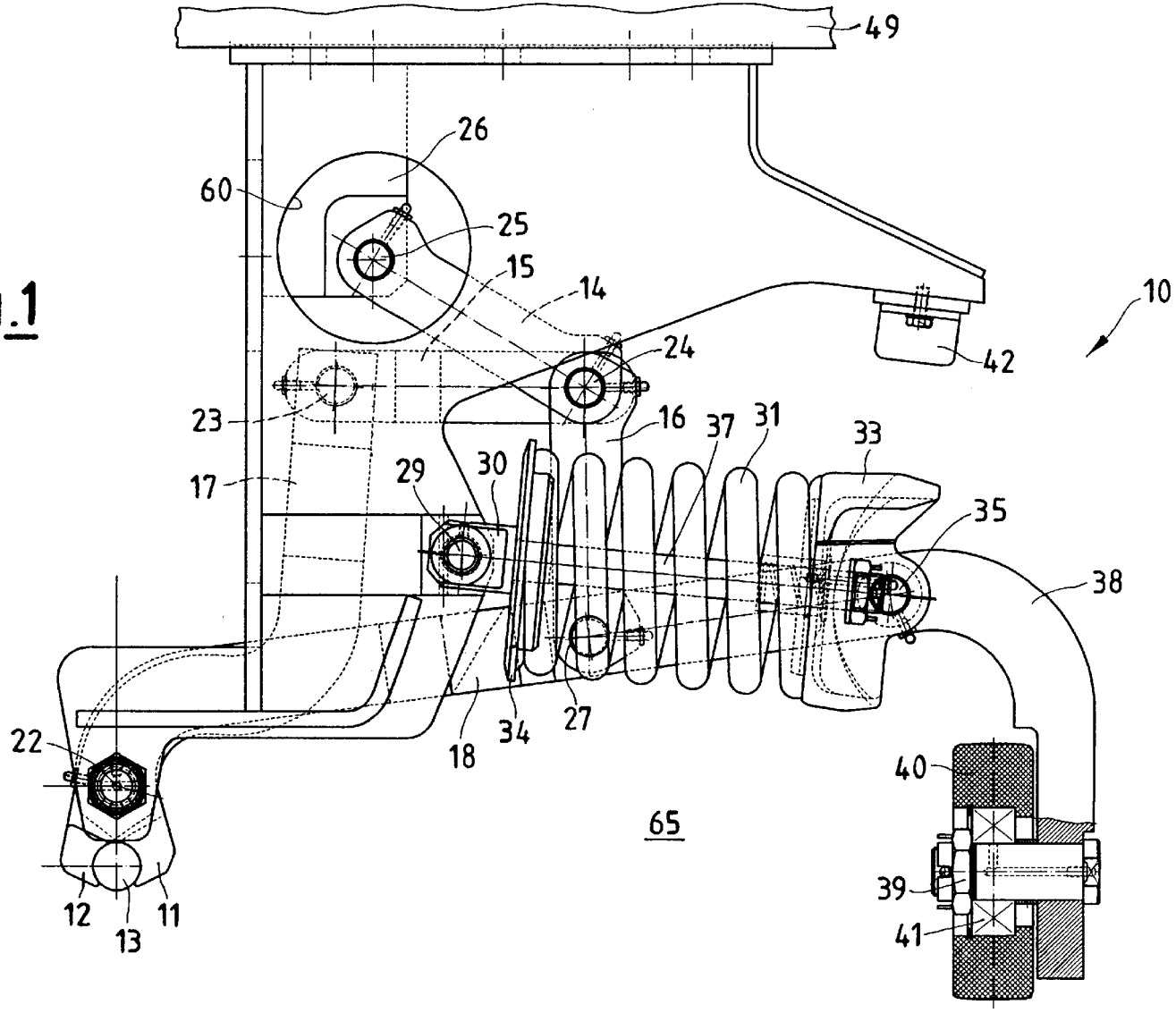
FIG. 1 shows a partly sectioned side view of an improved mobile jaw vice for clamping and unclamping vehicles to and from a traction cable of a transport system, according to the present invention, in working position.

With reference to the figures mentioned above, reference numeral 10 generically indicates a vice for clamping or unclamping vehicles 19 to a traction cable 13 of a transport system, in particular a funicular transport system, such as a fixed- or automatic-clamping cableway or funicular railway.

Vice 10, provided with two mobile jaws 11, 12, which grip or not cable 13, is arranged on a same plane with respect to the axis of rotation of its driving rollers 40, and it is fixed, in the lower side, to floor 20, whereas each vehicle 19 is mobile on sprung wheels 45, and is towed by cable 13.

In particular, vice 10 comprises two mobile arms 17, 18 for driving the jaws, respectively 11, 12, which are pivoted onto pivot 22, at the end facing the traction cable 13; at the opposed ends, arm 17 is hinged in 23 to a first lever 15, in turn hinged in 24 to a second lever 14, which is pivoted in 25 to a box-shaped support structure 26 of vice 10 to vehicle 19; on the other hand, arm 18 is connected to a third lever 16 through a hinge 27.

Finally, lever 16 is further connected to lever 15 through hinge 24, so as to obtain an articulated structure similar to a pantograph.

Two further hinges 29 are connected to the box-shaped structure 26, each connected to a helical spring 31 through a plate 30 adapted to make spring 31 rotate into a direction and into the opposed direction during the clamping and unclamping operations to and from cable 13.

The helical springs 31, pre-loaded in compression on a guide 37, are arranged between a fixed thrust plate 33, integral with the box-shaped structure 26 and hinged in 35 to arm 18 and to guide 37, and a mobile thrust plate 34, integral with plate 30.

Arm 18 elongates in a curved structure 38 connected, through fastening means 39, to the driving roller 40 through bearings 41.

Moreover, it is provided that a portion of the curved structure 38 can be brought into contact with an abutment element 42, fastened to the box-shaped structure 26, in a rest position of the vice 10 when vehicle 19 is unclamped from the traction cable 13, thanks to the fact that the driving roller 40 is forced to cover a trajectory on an inclined plane 21.

Figure 5:
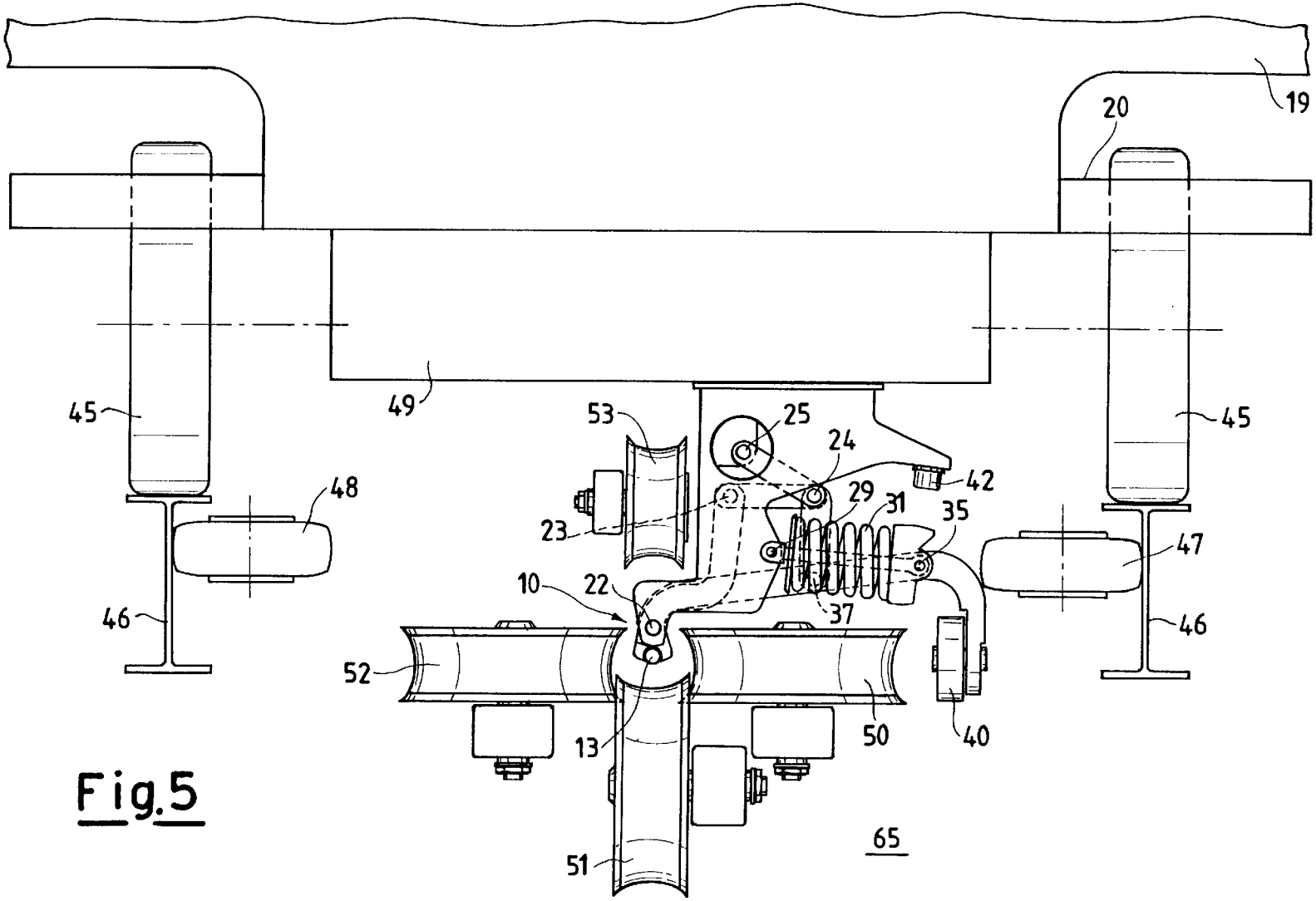
FIG. 5 shows a partly sectioned partial cross view of a funicular transport system with relevant vehicle, comprising an improved mobile jaw vice, with the several possibilities of arrangement of the cable-guiding rollers, according to the present invention.

With particular reference to FIG. 5, which relates to a portion of a funicular system where the vice 10 is used, according to the present invention, reference numeral 45 indicates the wheels of vehicle 19, reference numeral 46 indicates the profile of the rail where vehicle 19 is constrained, reference numerals 47 and 48 indicate two positioning rollers, reference numeral 49 indicates a orientating trolley, fastened to floor 20 of the telpher of vehicle 19, and reference numerals 50, 51, 52, 53 indicate the cable-guiding rollers, arranged along the line according to the requirements.

Figure 2:
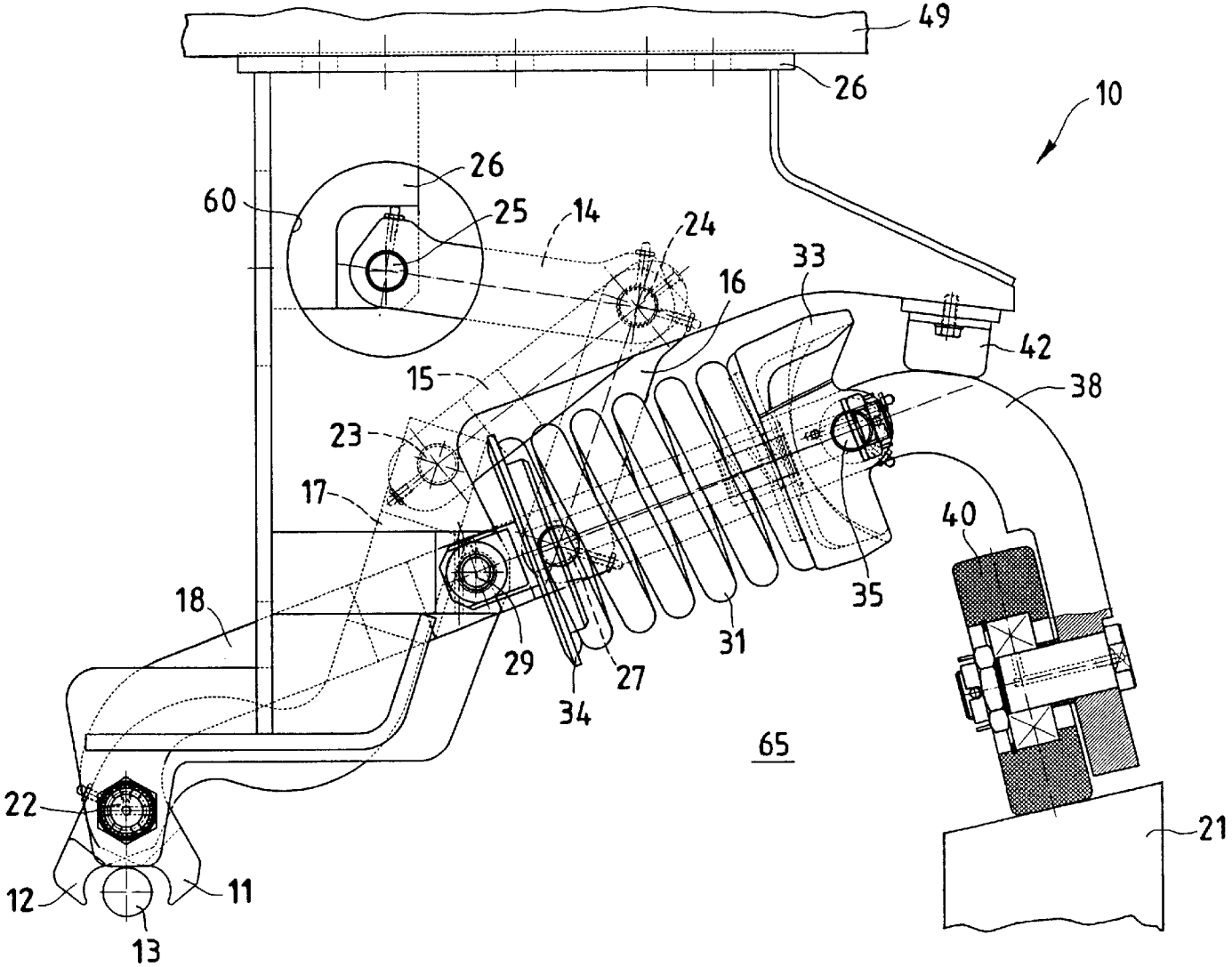
FIG. 2 shows a partly sectioned side view of the vice of FIG. 1, according to the present invention, in unclamping position.
Figure 3:
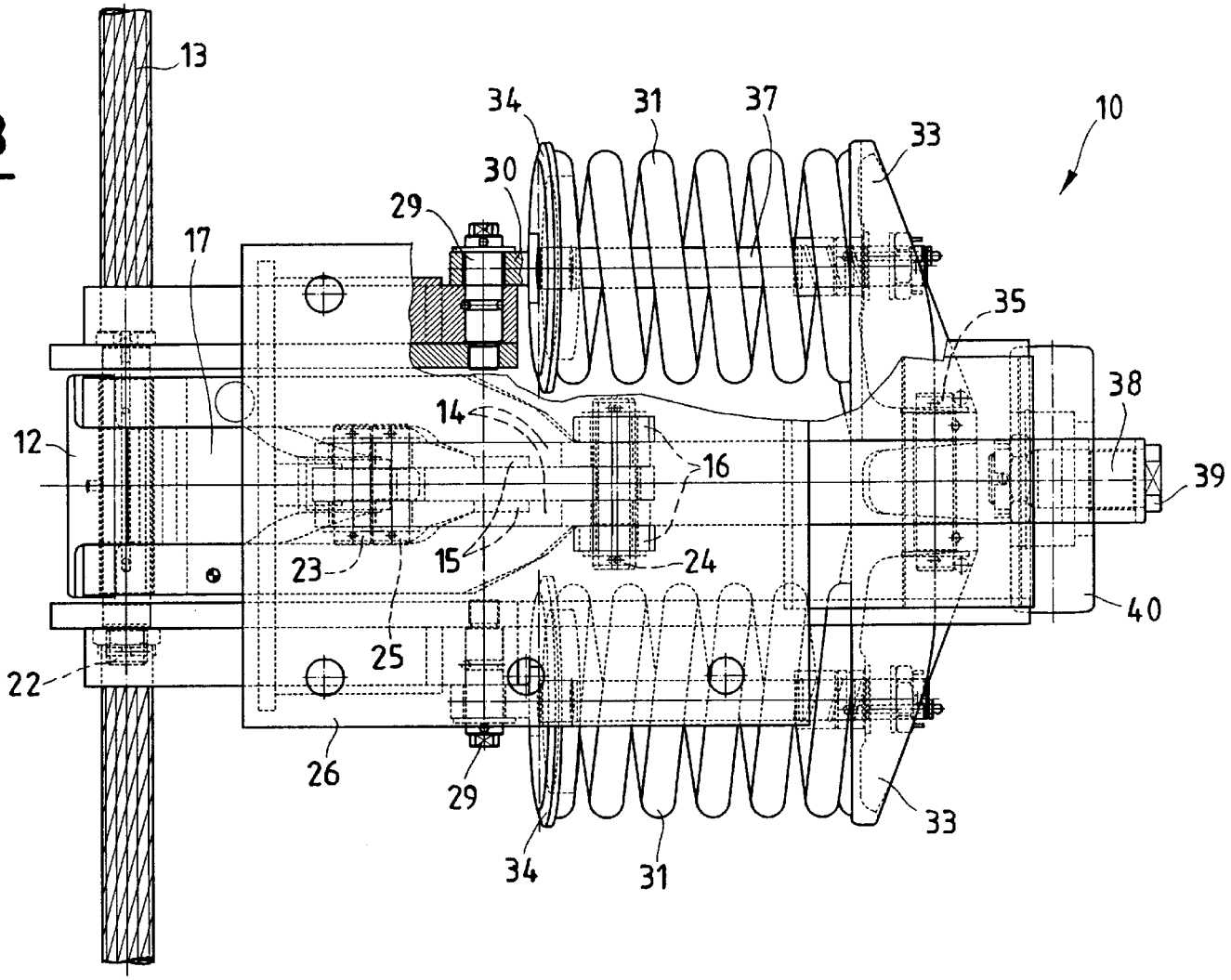
FIG. 3 shows a top view of the vice of FIG. 1, according to the present invention.
Figure 4:
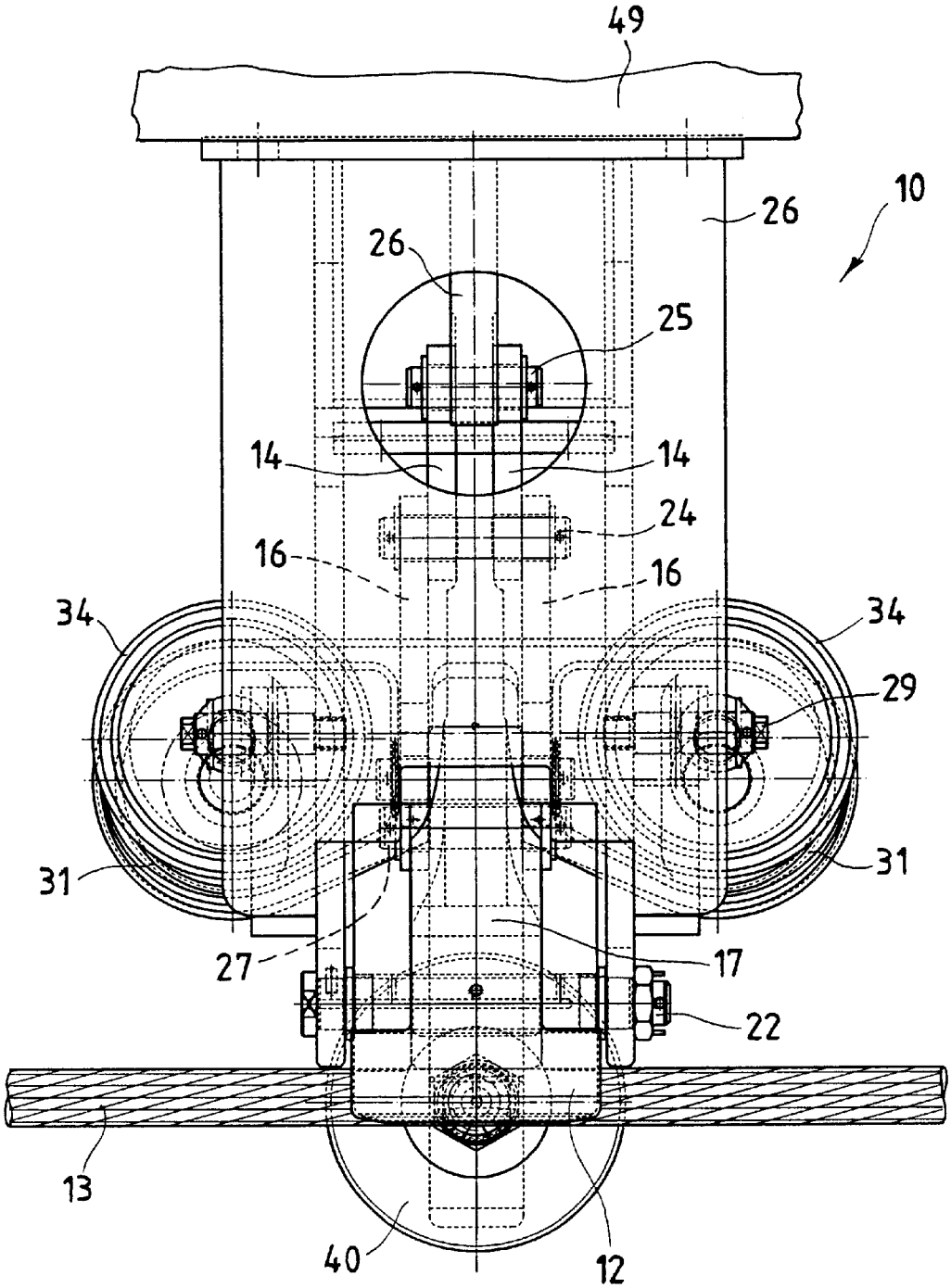
FIG. 4 shows an elevation view of the vice of FIG. 3, according to the present invention.

With particular reference to FIGS. 1 and 2, which respectively refer to a working or clamping position of the vice 10 to the traction cable 13, and to a rest or unclamping position of jaws 11 and 12 of the vice 10 from cable 13, it can be noted that the pantograph system of levers 14–16 allows such a movement as to obtain a substantially large opening of jaws 11, 12 with respect to the diameter of cable 13 to be clamped. In practice, using a helical spring 31 of the known type, the two jaws 11, 12 open concurrently, thus preventing said movement from causing any movement of cable 13.

Moreover, the closing action in perfect synchronism of jaws 11, 12 onto cable 13 guarantees a safe grip of the cable with a suitable clamping force, since the area of the portion of the grip synchronism increases considerably with respect to the prior art. Finally, the arrangement of levers 14–16 and the substantially arched shape of arms 17, 18 of the vice 10 guarantee the creation of a suitable space, indicated in FIGS. 1–2 with reference numeral 65, for housing the cable-guiding roller 50 (as it can directly be seen in FIGS. 2 and 5) in horizontal position. This is extremely useful for the purpose of avoiding the use of cable-guiding rollers in inclined position, which would thus be strongly stressed by cable 13. The arrangement in horizontal position of the cable-guiding roller 50 further prevents the occurrence of stresses, always present in the case of cable-guiding rollers arranged in inclined position with respect to that horizontal, which tend to make cable 13 lift and slip from its seat.

The operation of the vice 10 according to the present invention is substantially as follows.

In the passage from a working position to an unclamping position, roller 40 is forced to follow the trajectory of the inclined plane 21; the direct consequence of this is the raising of the arched portion 38 up to touching support 42. In this way, spring 31 substantially arranges itself in line with pivot or fulcrum 22, thanks to the fact that arm 18 is parallel to guide 37, along the imaginary axis passing through the hinging points 35, 27, 29.

At the same time, point 23, where arm 17 and lever 15 are constrained, moves towards point 29 of counter-clockwise rotation of spring 31, thanks to the movement of plate 30, whereas hinge 24 is not aligned any more with fulcrum 27 since it is forced to move rightwards.

As a consequence, since lever 14 is fastened to the box-shaped structure 26 into fulcrum 25, as it rotates in a counter-clockwise direction with respect to the same fulcrum 25, it will move to an almost horizontal position along the direction connecting the points 24 and 25.

Moreover, there is provided a hole 60 into structure 26, which is used for finely regulating the position of fulcrum 25, which must necessarily be manufactured with very strict working tolerances, due to the stress to which it is subject during the clamping and unclamping operations of vice 10.

Of course, in the case of passage from an unclamping position to a working position, the movements of arms 17, 18 and of levers 14–16 will be the same as described above, in a reverse order.

In this way, as it can be clearly seen in FIGS. 1, 2 and 5, the obtained opening width of jaws 11, 12 is suitable for firmly and safely clamping the traction cable 13 in any condition of oscillation of the same.

In fact, the presence of the articulated pantograph, which transversally translates to the advancement direction of the traction cable 13, causes a perfectly symmetrical drive of arms 17, 18, thus realising a large opening of the jaws, a correct clamp, a suitable clamping force, and a sufficient space for arranging the cable-guiding roller in horizontal direction.

Finally, the vice 10 according to the invention can be structured without dead centre, or with dead centre; moreover, for safety reasons, it is preferred to provide each funicular vehicle 19 with at least two vices 10, each forced to one of the end axles of vehicle 19.

The above description clearly shows the features of the improved mobile jaw vice for clamping and unclamping vehicles to and from a traction cable of a transport system, which is object of the present invention, and it clearly shows its advantages. Finally, it is clear that several variants can be made to the improved vice, object of the present invention, without departing from the novelty principles of the inventive idea, and it is also clear that, in the practical implementation of the invention, materials, shapes and sizes of the illustrated details can be of any type according to the requirements, and the same can be replaced with others, technically equivalent.

What is claimed is:

1. Mobile-jaw vice comprising mobile-jaws configured to clamp and unclamp to and from a traction cable of a transport system, wherein at least one spring, connected to a driving roller, is driven to allow clamping or unclamping the mobile-jaws to and from said traction cable through a plurality of arms, said arms being connected to one another through a system of levers and disposed in a support structure of a vehicle by fastening the system of levers in at least one fulcrum to the support structure, so that said system of levers produces an opening of said mobile-jaws larger than the diameter of said traction cable, such as to guarantee a wide area grip and synchronism to the traction cable, and provides a space for arranging at least one cable-guiding roller in horizontal direction with respect to a slide axis of said traction cable, wherein in an unclamping position, an arched portion of at least one of said arms moves towards a contact element in a predetermined direction, through the action of the driving roller, which is forced to move along an inclined plane.

2. Mobile-jaw vice according to claim 1, wherein said levers are hinged to one another and to said arms in at least three points.

3. Mobile-jaw vice according to claim 1, wherein said spring is connected to said support structure through at least one pivotable element, facing a median guide, corresponding to a stem of said spring.

4. Mobile-jaw vice according to claim 1, wherein at least one of said arms is hinged, in at least one point, to said spring.

5. Mobile-jaw vice according to claim 1, wherein at least one of said arms is pivoted, in at least one point to at least a first lever, said first lever being hinged, in at least one point to at least a second lever fastened to a box-shaped structure.

6. Mobile-jaw vice according to claim 1, wherein said system of levers functions as a pantograph both during the passage from a clamping position to an unclamping position and vice versa.

7. Mobile-jaw vice according to claim 1, wherein at least two hinging points of said arm and at least one hinging point of said spring are aligned, and said at least two hinging points and at least one hinging point are further aligned with another fulcrum for opening or closing said mobile-jaws, in the unclamping position.

8. Mobile-jaw vice according to claim 1, wherein said box-shaped structure exhibits at least one hole, through which it is possible to regulate the position of said fulcrum by means of at least one tool.

* * * * *